US005670728A

United States Patent [19]

Ogai et al.

[11] Patent Number: 5,670,728

[45] Date of Patent: Sep. 23, 1997

[54] MUSICAL TONE CREATING APPARATUS FOR ELECTRONIC MUSICAL INSTRUMENT

[75] Inventors: Yoichiro Ogai; Masahiro Shimizu, both of Hamamatsu, Japan

[73] Assignee: Yamaha Corporation, Japan

[21] Appl. No.: 437,619

[22] Filed: May 9, 1995

[30] Foreign Application Priority Data

May 10, 1994 [JP] Japan ..... 6-119677

[51] Int. Cl.[6] ..... G10H 7/00

[52] U.S. Cl. ..... 84/607; 84/603; 84/622

[58] Field of Search ..... 84/603, 604, 605, 84/606, 607, 621, 622, 615, 617, 661; 364/723

[56] References Cited

U.S. PATENT DOCUMENTS

| | | | |
|---|---|---|---|
| 4,246,823 | 1/1981 | Wachi et al. | 84/1.22 |
| 5,250,748 | 10/1993 | Suzuki | 84/661 |
| 5,252,773 | 10/1993 | Kozuki et al. | 84/607 |
| 5,290,965 | 3/1994 | Yoshida et al. | 84/605 |
| 5,300,725 | 4/1994 | Manabe | 84/609 |
| 5,319,151 | 6/1994 | Shiba et al. | 84/603 |
| 5,416,264 | 5/1995 | Toda et al. | 84/603 |

*Primary Examiner*—Jonathan Wysocki
*Assistant Examiner*—Marlon T. Fletcher
*Attorney, Agent, or Firm*—Graham & James LLP

[57] ABSTRACT

A pitch-asynchronous-type musical tone creating apparatus, provided for an electronic musical instrument, comprises at least a waveform memory, a low-pass filter and an interpolation section. Waveform samples, stored by the waveform memory, are sequentially read out, so that the interpolation section performs interpolation process on the waveform samples to create interpolation samples. Musical-tone parameters, such as a tone-color characteristic and an envelope characteristic, are imparted to the interpolation samples so as to create musical-tone samples. When performing reading operations on the waveform memory at a high speed which causes skipping of the reading operations, certain frequency components, which cause occurrence of folding noises, are incorporated into the interpolation samples. Those frequency components are removed from the waveform samples, read from the waveform memory, by the low-pass filter whose cut-off frequency is determined responsive to a frequency number. The frequency number is set responsive to a pitch designated for a musical tone to be produced. The low-pass filter is activated only when the frequency number is larger than a certain number so that skipping of the reading operations may occur. The musical-tone samples are accumulated with respect to a plurality of channels which operate in a time-division manner, so that musical tone signals, corresponding to musical tones to be produced, are created based on the musical-tone samples accumulated.

18 Claims, 10 Drawing Sheets

MUSICAL TONE CREATING APPARATUS FOR ELECTRONIC MUSICAL INSTRUMENT

BACKGROUND OF THE INVENTION

1. Field of the Invention

The present invention relates to musical tone creating apparatuses which create musical tone signals for electronic musical instruments on the basis of pitches designated.

2. Prior Art

Conventionally, waveform-memory sound sources are known as the musical tone creating apparatuses for the electronic musical instruments. The waveform-memory sound sources are designed to create musical tone signals based on samples of waveform data which are read from a waveform memory in accordance with pitches designated. Herein, samples of waveform data are read from the waveform memory at a variable reproduction rate in which sampling clocks are varied. When processing the samples of waveform data read out, filter calculations should be changed responsive to the sampling clocks which are varied. In addition, since each of tone-generation channels may have a different reproduction rate, it cannot create musical tone signals well. In order to overcome such a difficulty, a constant reproduction rate, in which the sampling clocks are constant, is employed; and samples of waveform data are read from the waveform memory while controlling a progression speed of read addresses by a frequency number (hereinafter, simply referred to as an 'F-number').

A musical tone creating apparatus, in which samples of waveform data (hereinafter, simply referred to as 'samples') are read from the waveform memory and musical tone signals are created at the constant reproduction rate, is called a pitch-asynchronous waveform-memory sound source. In order to set the constant reproduction rate for the pitch-asynchronous waveform-memory sound source, it is necessary to create a reproduced sample, at a certain timing corresponding to a sampling clock for reproduction, based on a read sample. In other words, an intermediate sample should be made between two samples which are respectively read from the waveform memory. In order to obtain the intermediate sample, Lagrange's interpolation or FIR filters are used to yield an 'interpolation sample'. This is disclosed by Japanese Patent Publication No.59-17838 and Japanese Patent Laid-Open No. 63-168695 which respectively correspond to U.S. Pat Nos. 4,246,823 and 5,250,748.

When providing multiple tone-generation channels in a pitch-asynchronous-type musical tone creating apparatus such as the pitch-asynchronous waveform-memory sound source, the apparatus is designed as a time-division type musical tone creating apparatus, generally known, in which tone-generation channels operate in a time-division manner to create musical tone signals. In that musical tone creating apparatus, a maximum number of tone-generation channels is fixed. In other words, an assignment of tone-generation tasks is performed within a fixed number of tone-generation channels so that the tone-generation channel, to which a certain tone-generation task is assigned, is activated to create a musical tone.

In the waveform memory which Is employed by the pitch-asynchronous-type musical tone creating apparatus conventionally known, reproduction of musical tone signals is performed while performing interpolation-filter processes. The interpolation-filter process is provided to meet the sampling theorem generally and is provided to cut off certain frequency components, which are above frequency components having a sampling frequency 'fs' at recording, in response to pitches to be generated. However, when reading out the samples from the waveform memory at a certain reading speed which enables reading of the samples with skipping, interpolation samples may contain so-called "folding noises" which cannot be removed by an interpolation filter. Specifically, when pitch data, having a pitch of 100 Hz at a recording sampling frequency fs of 40 kHz, is used to generate musical tones at a high pitch of 400 Hz which is higher than an original pitch by two octaves, reproduction should be performed with skipping three samples. In that case, overtone components, each having a frequency of 5 kHz or more, should be reproduced in four times the frequency; and consequently, the overtone components reproduced should exceed a frequency of 20 kHz which is a half of a reproducing frequency 'FS' of 40 kHz. Such components which exceed the frequency of 20 kHz are incorporated into frequency bands of interpolation samples so as to act like the folding noises.

If a reproducing sampling frequency is set at 'FS' and an F-number, which designates a pitch of a musical tone to be reproduced, is set at 'FN', skipping of reading occurs when FN exceeds '1'. Thus, recorded components, which are intended to be reproduced in a frequency band which ranges from 'FS/2' to '(FS/2)×FN', are folded into a frequency band which is lower than 'FS/2', so that they act as folding noises.

Some waveform-memory sound sources are designed to employ time-division channels so that interpolation is made between samples to create musical tone signals, wherein each time-division channel performs the interpolation. In order to do so, a total number of reading operations for the waveform memory is divided so that an even number of reading operations are allocated to each of the time-division channels. In some case, however, a time delay exists between the reading operations of the waveform memory; and the total number of reading operations is limited. In that case, a technology, in which an even number of reading operations are allocated to each of the time-division channels, is disadvantageous because of a low efficiency of reading of the waveform memory. In order to overcome such a difficulty, a temporary buffer is provided to temporarily store waveform samples which are read out with respect to the tone-generation channels respectively. Thus, only the waveform sample, which is newly required by a progression of reading addresses, is read out from the waveform memory.

The technology described above can be embodied by a musical tone creating apparatus which is made using a digital signal processor (i.e., DSP). Herein, a different number of reading operations can be set for each of the tone-generation channels. In that case, processing times for the tone-generation channels should be differed from each other in response to different numbers of reading operations. In contrast, a tone-creation process, which is activated after interpolating the waveform samples read out, does not have a time length which is proportional to the number of reading operations. In short, there is a problem that the DSP may have a relatively large degree of redundancy in terms of allocation of the processing times for the tone-generation channels formed in the DSP; in other words, an efficiency of usage of the DSP is very low.

SUMMARY OF THE INVENTION

It Is an object of the present invention to provide a musical tone creating apparatus for an electronic musical instrument which is capable of removing the folding noises without increasing a circuit scale so much and which is efficient in execution of processes for creating the musical tones.

The present invention relates to musical tone creating apparatuses for electronic musical instruments, and more particularly to a pitch-asynchronous-type musical tone creating apparatus.

The apparatus can be embodied using a digital signal processor which executes programs; and it comprises at least a waveform memory, a low-pass filter and an interpolation section. Waveform samples, stored by the waveform memory, are sequentially read out, so that the interpolation section performs interpolation process on the waveform samples to create interpolation samples. Musical-tone parameters, such as a tone-color characteristic and an envelope characteristic, are imparted to the interpolation samples so as to create musical-tone samples. When performing reading operations on the waveform memory at a high speed which causes skipping of the reading operations, certain frequency components, which cause occurrence of folding noises, are incorporated into the interpolation samples. Those frequency components are removed from the waveform samples, read from the waveform memory, by the low-pass filter whose cut-off frequency is determined responsive to a frequency number. The frequency number is set responsive to a pitch designated for a musical tone to be produced.

The low-pass filter is activated only when the frequency number is larger than a certain number so that skipping of the reading operations may occur. The musical-tone samples are accumulated with respect to a plurality of channels which operate in a time-division manner, so that musical tone signals, corresponding to musical tones to be produced, are created based on the musical-tone samples accumulated.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a musical tone creating apparatus according to an embodiment of the present invention will be described with reference to the drawings.

Figure 1:
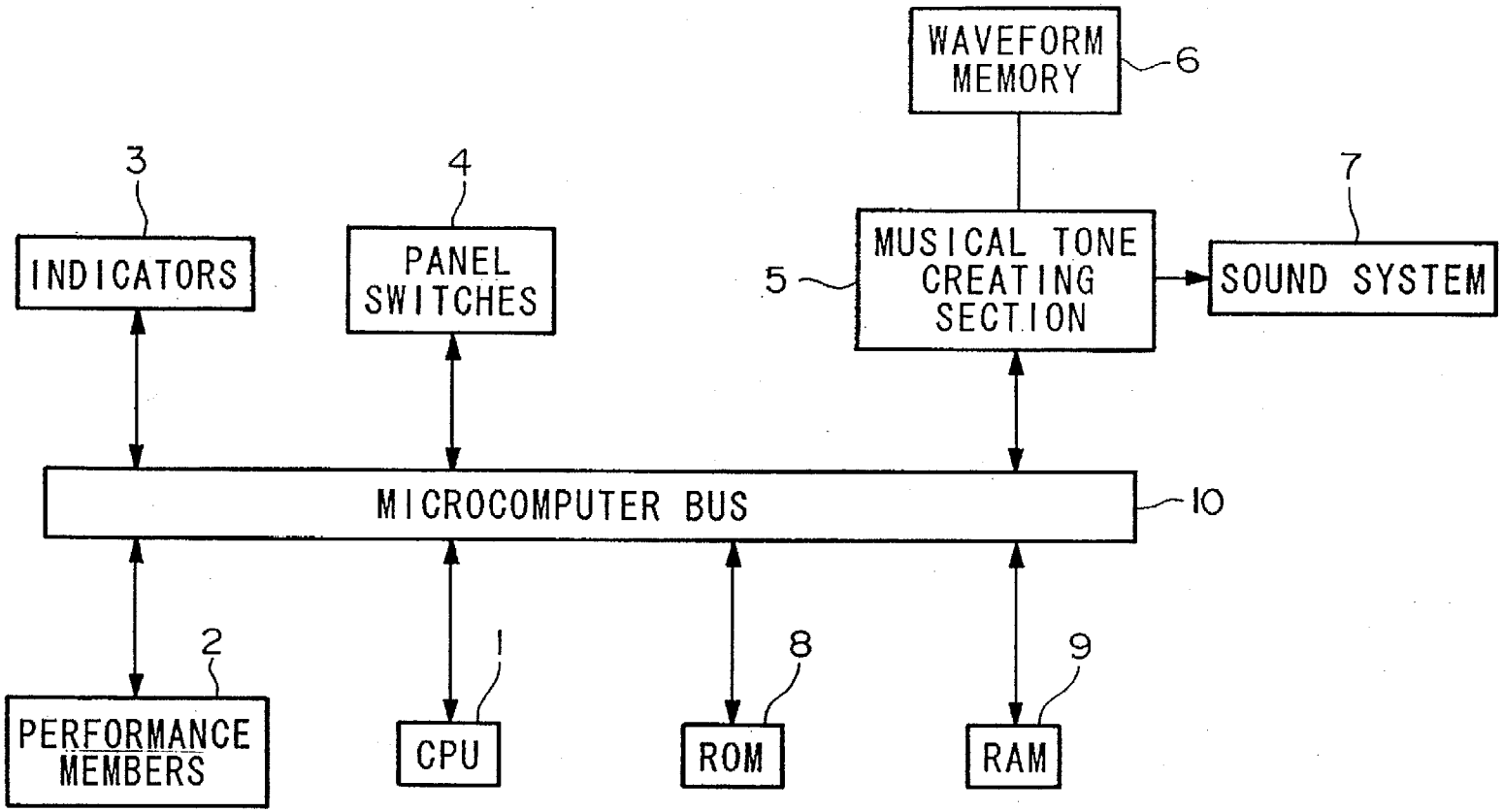
FIG. 1 is a block diagram showing an overall configuration of an electronic musical instrument incorporating a musical tone creating apparatus according to an embodiment of the present invention.

FIG. 1 is a block diagram showing an overall configuration of an electronic musical instrument incorporating the musical tone creating apparatus of the embodiment. There are provided a central processing unit (i.e., CPU), manual-operable members 2 for musical performance, such as keys of a keyboard, (simply referred to as 'performance members'), indicators 8, panel switches 4, a musical tone creating section (or a tone generator) 5, a waveform memory 6, a sound system 7, a read-only memory (i.e., ROM) 8, a random-access memory (i.e., RAM) 9 and a microcomputer bus 10.

The CPU 1 is connected with the microcomputer bus 10 so that the CPU 1 inputs data, which are transmitted onto the microcomputer bus 10, in accordance with CPU programs stored by the ROM 8. When the data inputted is data representative of detection of an event which occurs in the performance members 2, tone-generation data and tone-color data are transmitted to the musical tone creating section 5 through the microcomputer bus 10 so that generation of a musical tone is controlled. The musical tone which is generated has a 'preset' tone color which is selected from among multiple tone colors stored by the ROM 8 or a tone color corresponding to tone-color data which is read from the RAM 9. The RAM 9 stores the tone-color data which are set when a user operates the panel switches 4.

The musical tone creating section 5 processes waveform samples which are read from the waveform memory 6. Thus, the musical tone creating section 5 creates musical tone signals, based on the tone-generation data and tone-color data supplied, for the tone-generation channels respectively. The musical tone signals are supplied to the sound system 7 so that the sound system 7 produces musical tones correspondingly.

Figure 3:
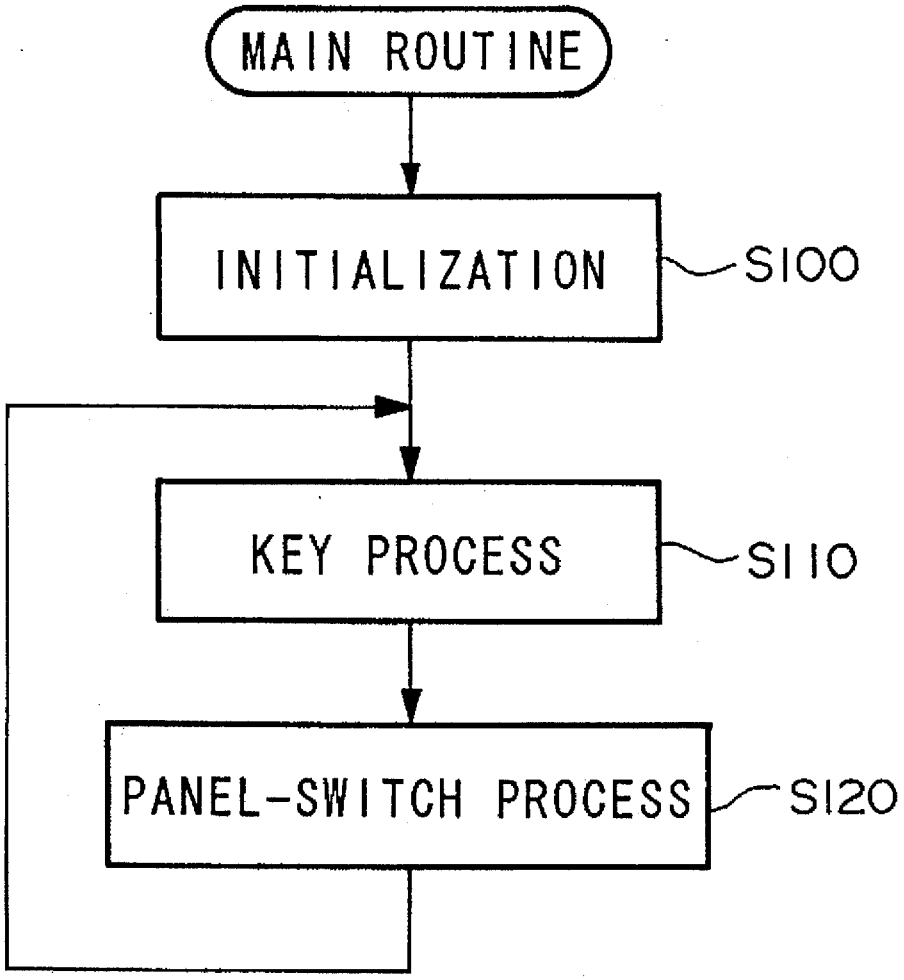
FIG. 3 is a flowchart showing a main routine which is executed by a CPU shown in FIG. 1.

Next, FIG. 3 shows a main routine for the CPU 1. The main routine is activated when electric power is applied to the electronic musical instrument so that the CPU 1 proceeds to first step S100. In the first step S100, initialization is performed so that a variety of registers are cleared and initial values are set in accordance with a certain procedure which is determined in advance. In next step S110, a key process is performed. In the key process, the CPU 1 scans key switches (i.e., performance members) 2 so as to detect a change in states of the keys. When detecting a key whose event is changed from 'OFF' to 'ON', an key-on-event routine is activated so that the CPU 1 instructs the musical tone creating section 5 to start generation of a musical tone which has a note number corresponding to the key detected. On the other hand, when detecting a key whose event is changed from 'ON' to 'OFF', the CPU 1 instructs the musical tone creating section 5 to stop generation of a musical tone which has a note number corresponding to the key detected.

Now, waveform designating information, which is designated by a note number corresponding to generation of a musical tone, is transmitted to the musical tone creating section 5, so that the musical tone creating section 5 accesses to the waveform memory 6 to read out a waveform sample designated by the waveform designating information. In step S120, a panel-switch process is performed In response to events which occur on the panel switches 4. Thereafter, the CPU 1 proceeds back to the step S110; and consequently, the steps S110 and S120 are repeated.

In the panel-switch process, the CPU 1 scans the panel switches 4 to detect a panel switch whose event is changed from 'OFF' to 'ON'. Thus, a certain program, called an "on-event routine", is executed with respect to the panel switch whose event is changed from 'OFF' to 'ON'.

Figure 5:
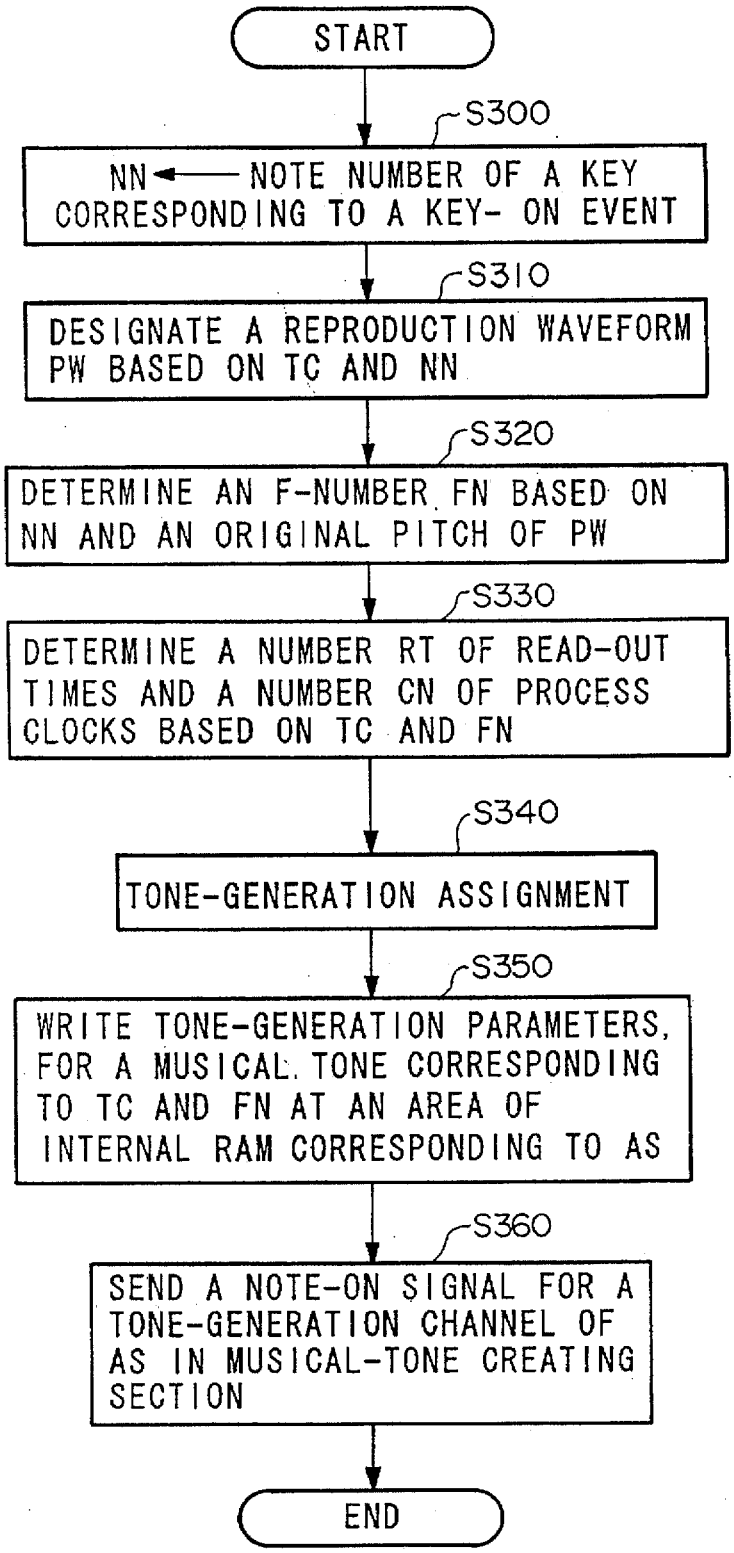
FIG. 5 is a flowchart showing a key-on-event routine.

FIG. 5 shows the key-on-event routine. In first step S300 of the key-on-event routine, a note number of a key on which a key-on event is newly detected is set as 'NN'. In step S310, a number 'PW' for a reproduction waveform is designated in response to a tone color 'TC' designated and the note number 'NN'. The tone color TC is required because a different waveform is stored by the waveform memory 6 with respect to each of tone colors and a different type of waveform is stored with respect to each of registers of the keyboard. In step S320, an F-number 'FN' is determined in response to an original pitch, corresponding to the number PW of the reproduction waveform, and the note number NN. The original pitch described above is a pitch of a waveform sample which is read from the waveform memory 6, wherein waveform samples are sequentially read from the waveform memory 6 by progressing reading addresses one by one in synchronization with sampling periods.

In step S330, a number of times, by which reading operations are performed, (hereinafter, simply referred to as a 'read-times number') 'RT' and a number of clocks used for processing (hereinafter, simply referred to as a 'process-clock number') 'CN' are determined based on the tone color TC and the F-number FN. When the F-number FN is equal to '1', a pitch read out coincides with its original pitch; therefore, folding phenomenon does not occur. However, if the F-number is increased larger than '1', the pitch read out becomes higher than the original pitch. In that case, if a musical-tone sample is produced at a constant reproduction rate, the folding phenomenon occurs. If the folding phenomenon occurs, it is necessary to perform a low-pass-filter process to remove high-frequency components which are caused by folding back a waveform sample in the musical tone creating section 5. In order to perform the low-pass-filter process, a certain number of clocks are required. In short, a process-clock number, required for a first state where the F-number FN is larger than '1', is made different from a process-clock number required for a second state where the F-number FN is at '1' or less.

The read-times number RT for the waveform memory 6 is a maximum number of times, by which reading operations are performed to read waveform samples from the waveform memory 6, in a sampling period in which a musical tone is created. In other words, the read-times number RT is proportional to the F-number FN. Reasons will be described below.

As described before, waveform samples are sequentially read from the waveform memory 6, in response to the F-number FN, without skipping, so that the waveform samples are used to perform interpolation. Therefore, an interpolation sample is produced in a constant sampling period. Thus, if the F-number FN is at '1.7', its corresponding read-times number RT is equal to '2' because the read-times number RT should be an integer. Similarly, if the F-number FN is at '2.7', its corresponding read-times number RT is at '3'. As a result, the read-times number RT is proportional to the F-number FN.

When the read-times number RT and the process-clock number CN are determined in step S330, assignment of a tone-generation-channel number 'AS' is performed in step S340. The tone-generation-channel number AS is a serial number which is assigned to each of the tone-generation channels. The step S340 has two processes, one of which is selected whether a specific condition is established or not. The specific condition describes that a number of resting clocks (hereinafter, simply referred to as a rest-clock number 'RCN') is larger than the process-clock number CN and a number of times at which reading operations are rested (hereinafter, simply referred to as a rest-read-times number 'RRT') is larger than the read-times number RT. If the condition is established, one process is activated so that a set of the read-times number RT and the process-clock number CN for a tone-generation channel is assigned to a new key-on event. If the condition is not established, a truncate process is performed so as to perform a muting process on a tone-generation channel; and then, a set of the read-times number RT and the process-clock number CN, which have been once secured by the tone-generation channel muted, are released so that they can be newly used as the rest-read-times number and rest-clock number which can be assigned to a new key-on event. Next, in step S350, musical-tone parameters, which correspond to the tone color TC and the F-number FN, are written into an area of an internal RAM, provided in the musical tone creating section 5 (see FIG. 2), so that the musical tone creating section 5 creates a musical tone by using the musical-tone parameters. The above area is determined responsive to the tone-generation channel number AS. The musical-tone parameters are provided to indicate the F-number FN and control data of an envelope. In addition, they are provided to indicate as to whether or not the low-pass-filter process is required. If the low-pass-filter process is required, some musical-tone parameter indicates a filter coefficient. In step S360, a note-on signal is sent to a tone-generation channel, corresponding to the tone-generation-channel number AS, provided in the musical tone creating section 5. Thus, a start address is set to an address register AD. In addition, a certain process is activated to start computation of creating envelope data. As a result, a musical-tone sample is produced in a tone-generation channel to which a tone-generation task is assigned.

Figure 4:
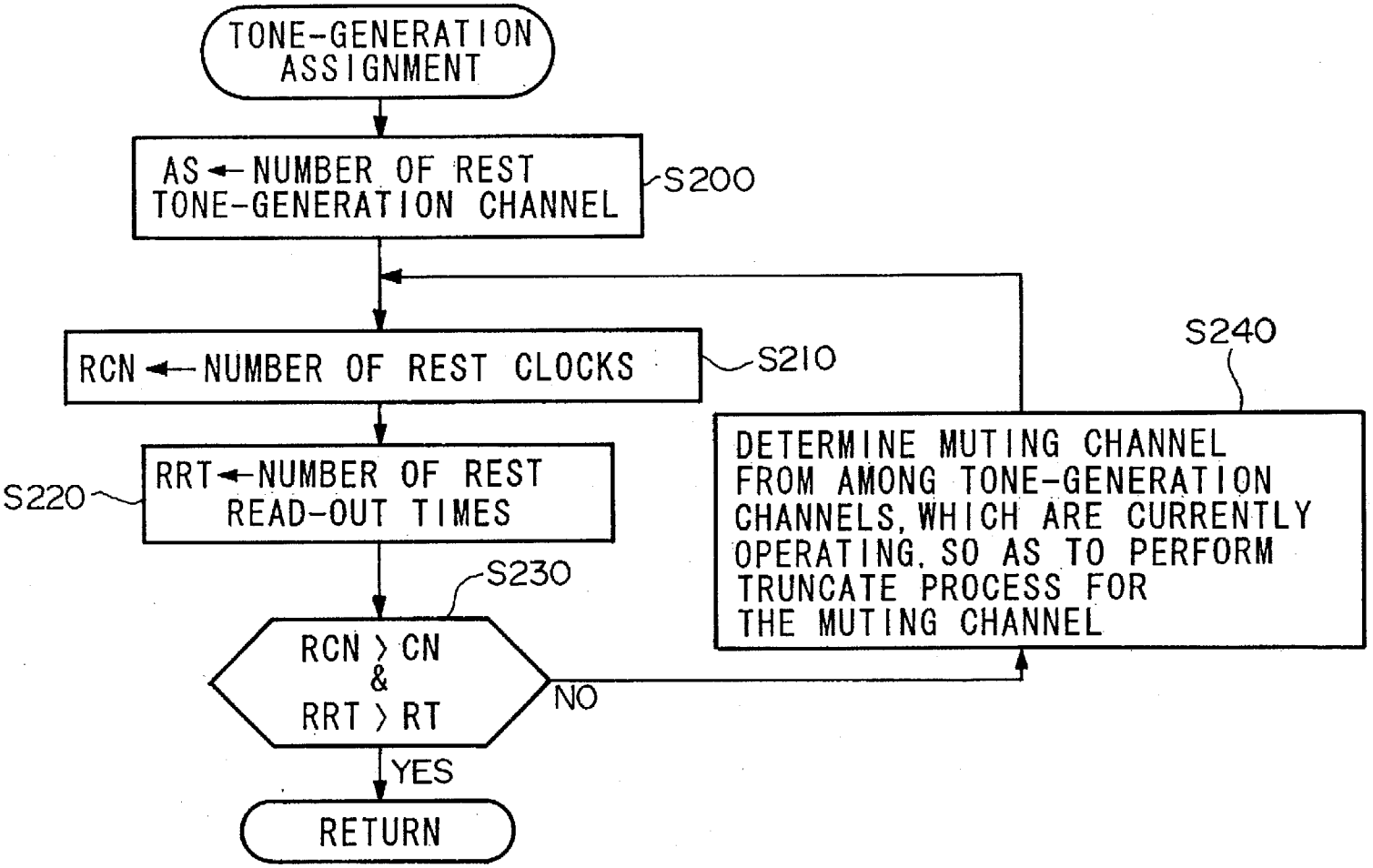
FIG. 4 is a flowchart showing a subroutine of tone-generation assignment.

FIG. 4 shows a subroutine of tone-generation assignment which is performed by the step S340 in FIG. 5.

In first step S200 of this subroutine, one of the tone-generation channels, which are not currently used for generation of musical tones, is secured so that a serial number thereof is used as the tone-generation-channel number AS. Thereafter, the rest-clock number RCN is set in step S210; and the rest-read-times number RRT is set in step S220. Herein, the rest-clock number is defined as a number of steps which are rested. It is calculated by subtracting a number of steps, which have been already assigned to another tone-generation channel, from a total number of steps which can be performed by a computation section 11 of the musical tone creating section 5 in a sampling period to create a musical tone. The rest-read-times number is calculated by subtracting a read-times number, which has been already assigned to another tone-generation channel, from a total read-times number indicating a maximum number of times by which reading operations can be performed in a sampling period to read out waveform samples from the waveform memory 6. Step S230 determines whether or not two conditions are simultaneously established. One condition describes that the rest-clock number RCN is larger than the process-clock number CN required for generation of a musical tone, while another condition describes that the rest-read-times number RRT is larger than the read-times number RT required for generation of a musical tone. If the two conditions are simultaneously established, execution of the subroutine of FIG. 4 is ended. If not, the CPU 1 proceeds to step S240 In which a muting channel (i.e., a tone-generation channel whose musical tone should be muted) is selected from among tone-generation channels, which are currently occupied in generation of musical tones, so that a truncate process is performed on the muting channel. Thereafter, the CPU 1 returns back to the step S210. Thus, the read-times number RT and the process-clock number CN, used by the muting channel, are released so that those numbers can be secured for a tone-generation channel which is activated responsive to a new key-on event.

A limited number of clocks, which is determined in advance, is set for the computation section 11, while a limited read-times number, which is determined in advance, is set for access to the waveform memory 6. The subroutine of tone-generation assignment is designed in such a way that a necessary number of clocks and a necessary read-times number, which are required for a tone-generation channel activated responsive to a key-on event, are selected from among the limited numbers described above on demand. In other words, a sum of read-times numbers, which are required for tone-generation channels occupied in generation of musical tones, can be minimized; and a sum of process-clock numbers, which are required for the tone-generation channels, can be minimized as well. Thus, the present embodiment can offer a time-division-type musical tone creating apparatus having a small degree of redundancy. A total number of tone-generation channels provided is set larger than a number of tone-generation channels which are actually activated to generate musical tones.

Figure 2:
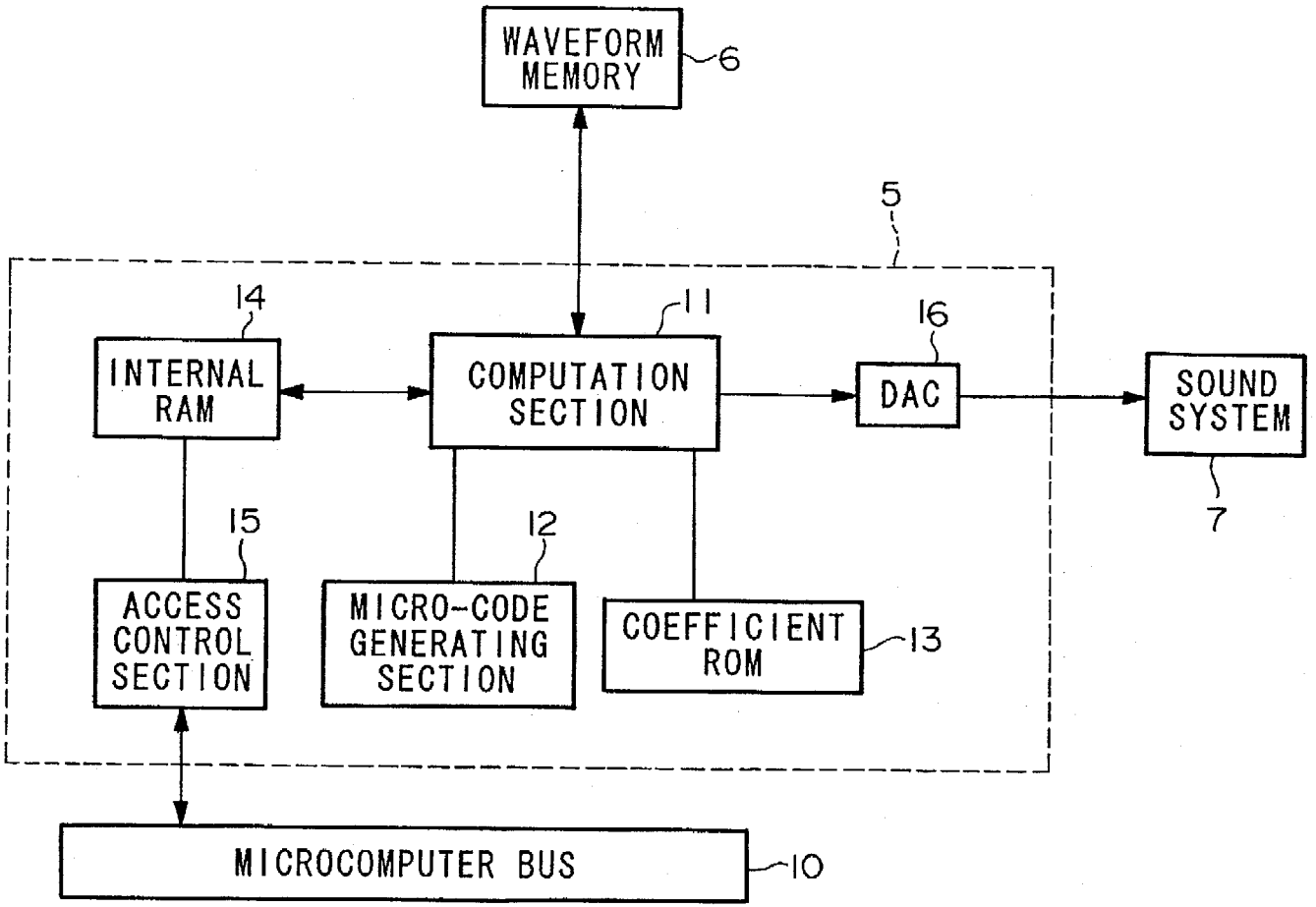
FIG. 2 is a block diagram showing a detailed configuration of a musical tone creating section shown in FIG. 1.

Next, FIG. 2 shows a detailed configuration of the musical tone creating section 5. The musical tone creating section 5 can be realized in practice by a DSP, for example.

In FIG. 2, the musical tone creating section 5 is configured by the computation section 11, a micro-code generating section 12, a coefficient ROM 13, an internal RAM 14, an access control section 15 and a digital-analog converter (i.e., 'DAC') 16. The computation section 11 is designed in such a way that waveform samples are read from the waveform memory 6 without skipping; the waveform samples read out are used to create an interpolation sample; and a musical-tone sample is created responsive to a pitch, which is designated by a pitch designating member or the like, by every constant sampling period. The micro-code generating section 12 generates micro-codes which control operations of the computation section 11. The coefficient ROM 13 provides a table form which stores coefficients of a low-pass filter in connection with F-numbers, wherein the low-pass filter is provided to cut off high-frequency components so that the folding phenomenon will not occur. The internal RAM 14 has functions to act as buffers or registers which can be commonly provided for the tone-generation channels or which can be independently provided for each of the tone-generation channels. In addition, the internal RAM 14 stores a read pointer and a write pointer as well. The access control section 15 is activated when the CPU 1 accesses to the musical tone creating section 5. The access control section 15 monitors states of the computation section 11 to preform an access control. The digital-analog converter 16 converts a musical-tone sample from a digital-signal form to an analog-signal form.

The musical tone creating section 5 provides multiple tone-generation channels which operate in a time-division manner to create musical tones.

Figure 6:
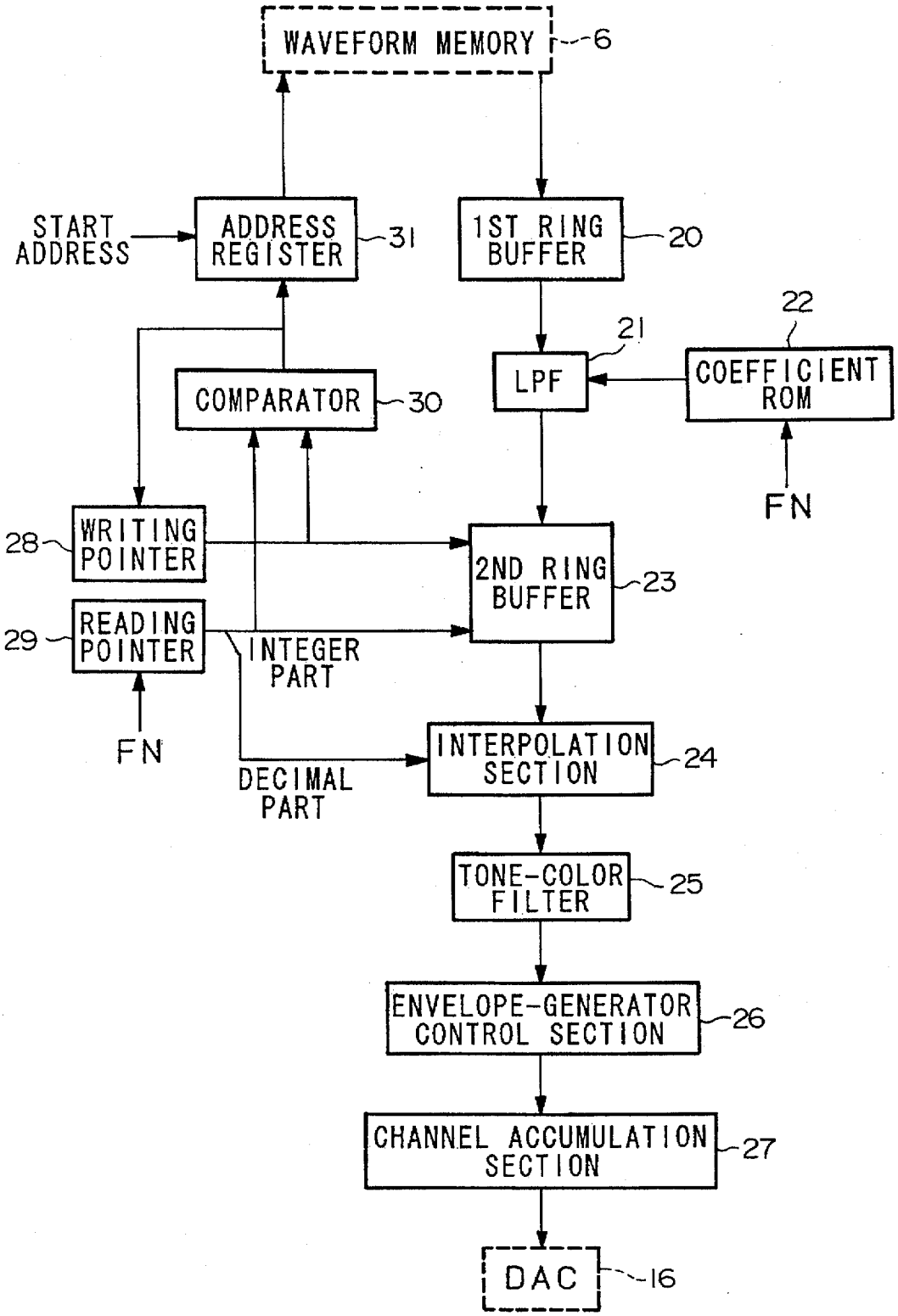
FIG. 6 is a block diagram which is used to explain conceptual operations of a computation section shown in FIG. 2.

FIG. 6 shows functional blocks representing conceptual operations of the computation section 11 provided in the musical tone creating section 5. The operations of the computation section 11 will be described in detail with reference to FIG. 6.

Waveform samples read from the waveform memory 6 are written into a second ring buffer 23. The F-numbers FN are supplied to a read pointer (represented by a symbol 'RP') 29. The F-numbers are accumulated to produce a value consisting of an integer part and a decimal part. The integer part is used as a read address for the second ring buffer 23 so as to read out the waveform samples. If the F-number FN is greater than '1', there is a possibility that reading of the waveform samples is performed on the second ring buffer 23 with skipping. As the F-numbers are accumulated, the read address is successively renewed. Hence, it is necessary for a write address of a write pointer (represented by 'WP') 28 to catch up with the read address successively renewed. In order to do so, the integer part of the read address and the write address are supplied to a comparator 30. Result of comparison controls the write pointer 28 such that the write address is progressed one by one at an appropriate timing. For example, if the write address is smaller than the read address by '1', the result of comparison of the comparator 30 controls the write pointer 28 such that the write address is progressed by '1' and it also controls an address register 31 such that its address is progressed by '1'.

When the address of the address register 31 is progressed by '1', a waveform sample corresponding to the address progressed is read from the waveform memory 6 and is written into a first ring buffer 20. In addition, the F-number FN is supplied to a coefficient ROM 22. When the F-number FN exceeds '1', high-frequency components are removed by a low-pass filter (represented by a symbol 'LPF') 21 in order that the folding phenomenon will not occur. However, a cut-off frequency of the low-pass filter 21 differs responsive to the F-number FN. Therefore, a filter coefficient, corresponding to the F-number FN, is transmitted from the coefficient ROM 22 to the low-pass filter 21. The waveform sample, read from the first ring buffer 20, is subjected to low-pass-filter process by the low-pass filter 21, from which the waveform sample filtered is outputted to the second ring buffer 23. The waveform sample is written into the second ring buffer 23 at a write address which is designated by the write pointer 28 and is progressed by '1'.

If the read address, designated by the read pointer 29, is progressed by '2' or more, an output of the comparator 30 controls the write pointer 28 and the address registers 31 to progress their addresses by '1'; however, the write address progressed is set behind the read address designated by the read pointer 29. In that case, another output of the comparator 30 is issued to further progress the write address. Thus, the waveform sample filtered by the low-pass filter 21 is written into the second ring buffer 23. The comparator 30 produces the output thereof repeatedly until the write pointer 28 catches up with the read pointer 29. Incidentally, when the F-number FN is at '1' or less, the waveform sample read out passes through the low-pass filter 21 so that it is directly written into the second ring buffer 23.

Next, the waveform sample is read from the second ring buffer 23 in response to the integer part of the read address designated by the read pointer 29. Then, the waveform sample is supplied to an interpolation section 24 in which the decimal part of the read address is used as an intermediate address so as to calculate a value for an interpolation sample. For example, the interpolation section 24 is designed in such a way that four waveform samples are used to calculate a value for one interpolation sample. A tone-color filter 25 performs tone-color-filter process which is designated by the value of the interpolation sample. An envelope-generator control section 26 performs envelope control (i.e., tone-volume control) on a sample value by using an envelope function representing an envelope which is started to be generated in response to a note-on signal. A channel accumulation section 27 is provided with respect to a plurality of channels. Thus, sample values of the channels are accumulated together with respect to a same sampling period so that mixed waveform samples are created with respect to the same sampling period. Results of accumulation are outputted by every sampling period. Digital signals, corresponding to the mixed waveform samples, representative of musical tones created by multiple tone-generation channels, are converted into analog signals by the digital-analog converter 16.

As described above, the computation section 11 performs a series of operations such that the write pointer 28 catches up with the read pointer 29 when the integer part in result of accumulation of the F-numbers is used as the read address to read out the waveform sample from the second ring buffer 23. In addition, the waveform samples are sequentially read from the waveform memory 6; and they are directly written into the second ring buffer 23 or they are written into the second ring buffer 23 after being subjected to the low-pass-filter process by the low-pass filter 21. Therefore, reading of the waveform samples from the waveform memory 6 can be performed by a certain number of times, which corresponds to the F-number FN, in one sampling period. In addition, the waveform samples, which are filtered to remove frequency components causing the folding noises, can be read from the second ring buffer 23. As a result, it is possible to avoid occurrence of the folding noises in values of interpolation samples outputted from the interpolation section 24.

Figure 7:
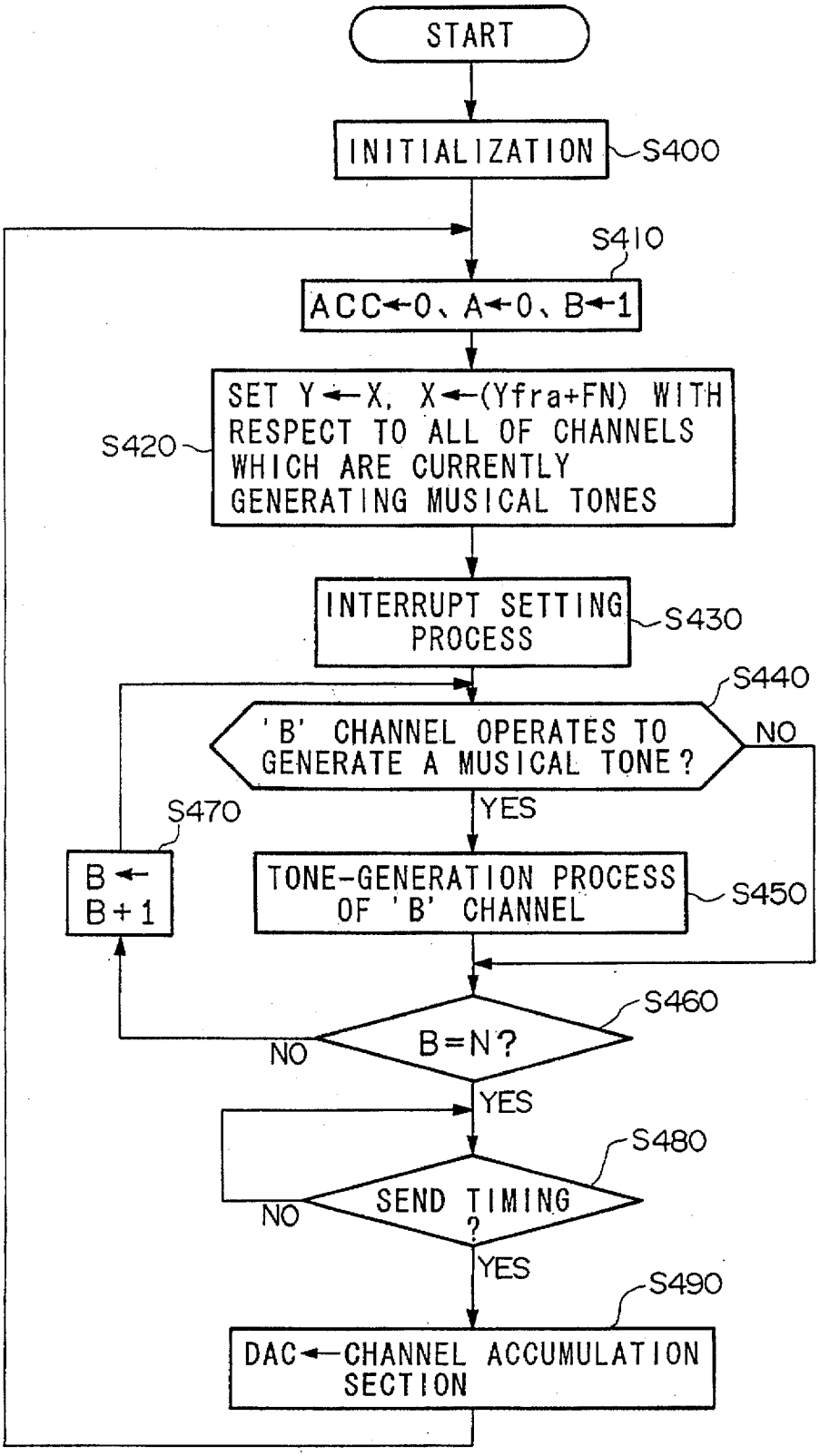
FIG. 7 is a flowchart showing a microprogram which is executed by a DSP.

The computation section 11, shown by FIG. 6, is normally configured using a DSP. FIG. 7 is a flowchart showing a microprogram (or microprograms) executed by the DSP.

When electric power is applied to the electronic musical instrument, the DSP is activated to start execution of the microprogram. In first step S400 in FIG. 7, initialization is performed to reset registers and the like. In next step S410, a value '0' is set to a channel-accumulation register ACC; a value '0' is set to a channel number 'A' representative of a channel which is currently occupied in reading out a waveform sample (or waveform samples) from the waveform memory 6; and a value '1', representative of a first channel number, is set to a channel number 'B' representative of a channel which is currently occupied in carrying out a tone-generation process. In step S420, a value 'X' of an auxiliary counter, provided for a reading operation of the waveform memory 6, is set as a value 'Y' of an auxiliary counter provided for a tone-generation process; and a decimal part 'Yfra' of the value Y is added to the F-number FN to produce a new value for the value X. Those operations of the step S420 are performed with respect to all of the channels which are currently occupied in carrying out tone-generation processes respectively. For convenience's sake, the value X is called "waveform-read-counter value X", while the value Y is called "tone-generation-counter value Y".

If a waveform sample is read out from the waveform memory at a current sampling timing, a tone-generation process for the waveform sample read out should be performed at a next sampling timing. For this reason, the tone-generation-counter value Y should be delayed behind the waveform-read-counter value X by one sampling timing. In order to secure such a delayed state, the step S420 is performed in such a way that the waveform-read-counter value X is set as the tone-generation-counter value Y; and then, the integer part Yfra of the tone-generation-counter value Y is added to the F-number FN to produce a new value for the waveform-read-counter value X at the next sampling timing. Thus, an integer part of the waveform-read-counter value X represents a number of times by which reading operations are performed on the waveform memory 6 at the next sampling timing; and the decimal part Yfra of the tone-generation-counter value Y is used as an intermediate address which is used for interpolation at the current sampling timing.

Next, an interrupt setting process is performed in step S430 so as to read out waveform samples from the waveform memory 6, wherein details of the interrupt setting process will be described later. In step S440, decision is made as to whether or not a channel corresponding to the channel number B is currently occupied in generating a musical tone. If so, the computation section 11 (i.e., DSP) proceeds to step S450 in which a tone-generation process for the channel number B is carried out, wherein details of the tone-generation process will be described later. After execution of the tone-generation process of step S450, the DSP proceeds to step S460. The step S460 is activated as well when a result of decision of the step S440 is "NO". In the step S460, decision is made as to whether or not the channel number B coincides with a last channel number 'N'. If the DSP judges that the channel number B does not reach the last channel number N, the DSP proceeds to step S470 in which '1' is added to the channel number B to produce a new number for the channel number B. Then, the DSP proceeds to step S440 again. Thus, a series of steps consisting of the steps S440, S450 and S460 are repeated until the channel number B reaches the last channel number N.

When the step S460 judges that the channel number B coincides with the last channel number N, the DSP proceeds to step S480 in which a 'send timing', by which the aforementioned mixed waveform samples are sent to the DAC 16, is adjusted to set the sampling period at constant. In step S490, a sum of the sample values of the multiple channels which are accumulated by the channel accumulation section 27 is supplied to the digital-analog converter 16. Thereafter, the DSP proceeds back to the step S410.

A series of steps from the step S410 to the step S490 are carried out in one sampling period; and consequently, a musical tone is created by every sampling period which is constant.

Figure 8:
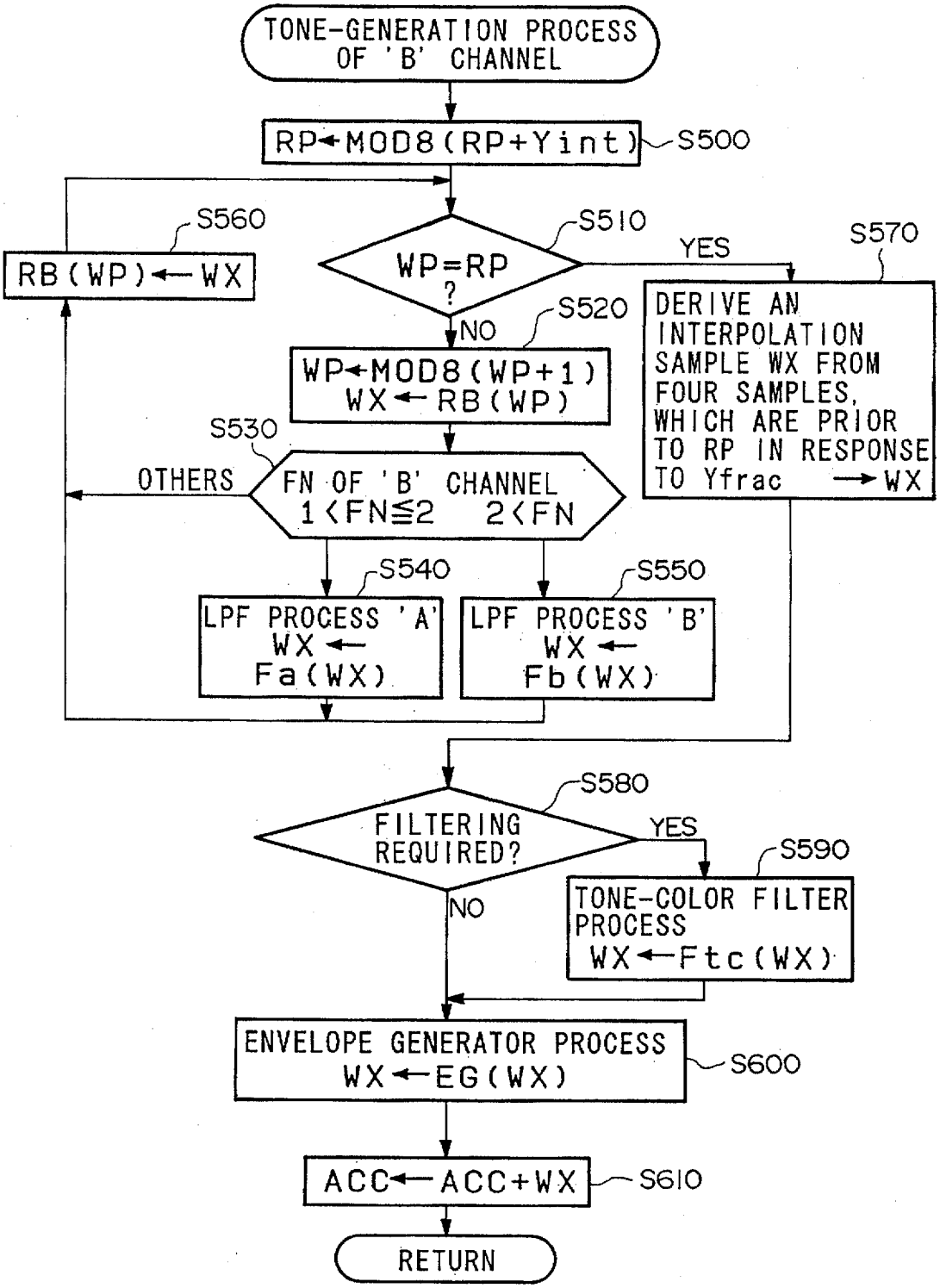
FIG. 8 is a flowchart showing a subroutine of tone-generation process which is executed by the DSP.

FIG. 8 is a flowchart showing a subroutine of tone-generation process of the DSP. In first step S500, a current read-pointer value 'RP' of the read pointer 29 for the second ring buffer 23 (called a "ring buffer RB") is added to an integer part 'Yint' of the aforementioned tone-generation-counter value Y; and then, a modulo-8 calculation, represented by "MOD8", is performed using result of addition, so that result of the modulo calculation is used as a new value for the read-pointer value RP. In next step S510, decision is made as to whether or not the read-pointer value RP coincides with a write-pointer value 'WP' of the write pointer 28. If they do not coincide with each other, it is necessary to read out a new waveform sample. Thus, the DSP proceeds to step S520 in which '1' is added to the write-pointer value WP; and then, a modulo-8 calculation is performed using result of addition, so that result of the modulo-8 calculation is used as a new value for the write-pointer value WP. An address corresponding to the new write-pointer value WP is used to read out a waveform sample 'WX' from the ring buffer RB.

In a previous sampling period, the waveform-read-counter value X is renewed in response to the F-number FN, so that a waveform sample is read out from the waveform memory 6 by using an address corresponding to the value X renewed. Thus, the waveform sample read out has been already written into the ring buffer RB at an address whose value is progressed by '1' as compared to the write-pointer value WP. Therefore, the waveform sample is read out from the ring buffer RB in a current sampling period as the waveform sample WX.

The modulo-8 calculation is employed because the ring buffer RB is configured as an 8-stage-type ring buffer.

Next, step S530 is provided to evaluate the F-number FN for the channel number B representing the channel on which a tone-generation process is performed. Specifically, decision is made as to whether or not the F-number FN belongs to a first range, a second range or other ranges. The first range describes "1<FN≦2", wherein the first range is selected to enable an increase of pitch within a one-octave range. The second range describes "2<FN", wherein the second range is selected to enable an increase of pitch by one octave or more. If the F-number FN belongs to the first range, the DSP proceeds to step S540 in which a low-pass-filter process 'A' is effected on the waveform sample WX in order to avoid occurrence of the folding noise. If the F-number FN belongs to the second range, a low-pass-filter process 'B' is effected on the waveform sample WX in order to avoid occurrence of the folding noise.

As compared to the low-pass-filter process A, the low-pass-filter process B is sharp in filter characteristic. In each of the low-pass-filter processes A and B, a cut-off frequency is set in response to the F-number FN.

If the step S530 judges that the F-number FN belongs to the other ranges, the DSP proceeds directly to step S560. The step S560 is activated after completing each of the steps S540 and S550 as well. In the step S560, the waveform sample WX is written into the ring buffer RB at an address corresponding to the write-pointer value WP. Thereafter, the DSP proceeds back to the step S510. Thus, the waveform sample, which is processed such that the folding noise will not occur, is written into the ring buffer RB.

A series of steps from the step S510 to the step S560 are repeated until the write-pointer value WP catches up with the read-pointer value RP. When the step S510 judges that the write-pointer value WP coincides with the read-pointer value RP, the DSP proceeds to step S570 in order to enable execution of an interpolation process. The step S570 uses four waveform samples stored at addresses which are prior to a read address designated by the read-pointer value RP. The four waveform samples are subjected to the interpolation process to create an interpolation sample 'WX' in response to the decimal part Yfra of the aforementioned tone-generation-counter value Y.

In step S580, decision is made as to whether or not filtering is required. If so, the DSP proceeds to step S590 in which a tone-color-filter process is performed on the interpolation sample WX. Thereafter, the DSP proceeds to step S600. The step S600 is activated as well when the step S580 judges that no filtering is required. In step S600, an envelope-generator process is performed on the interpolation sample WX so as to create a musical-tone sample 'WX'. In step S610, the musical-tone sample created is added to another musical-tone sample, which is created by another channel, by the channel accumulation register ACC. At a completion of the step S610, execution of the subroutine of tone-generation process of FIG. 8 is completed.

The subroutine of tone-generation process describes as if a musical-tone sample is created with respect to each channel. However, as shown by FIG. 7, the tone-generation process is repeated until the channel number B reaches the last channel number N. As a result, musical-tone samples are created for tone-generation channels respectively in a time-division manner.

Figure 9:
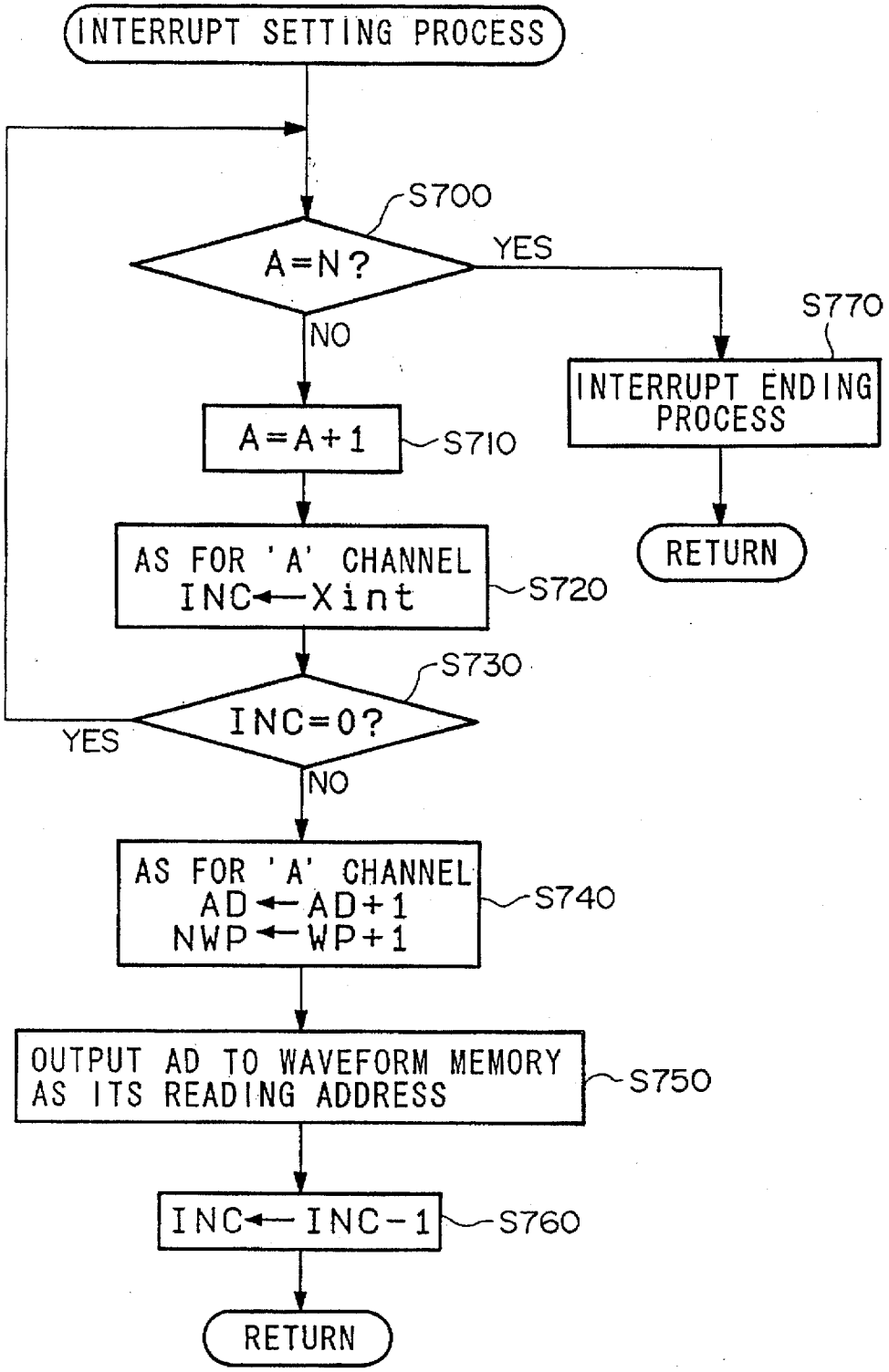
FIG. 9 is a flowchart showing an interrupt setting process.

FIG. 9 is a flowchart showing the interrupt setting process. In first step S700, decision is made as to whether or not the channel number A coincides with the last channel number N, wherein the channel number A represents a channel which is activated to read out a waveform sample (or waveform samples) from the waveform memory 6. Herein, the channel number A represents the channel which has been already processed. If the channel number A coincides with the last channel number N, the DSP proceeds to step S770 in which an interrupt ending process is performed so that execution of the interrupt setting process is ended. If not, it is indicated that there exists a channel (or channels) which is not processed. In that case, the DSP proceeds to step S710 in which '1' is added to the channel number A so as to create a new number for the channel number A. The 'new' channel number A represents a new channel which has not been processed yet. In step S720, the integer part Xint of the waveform-read-counter value X, regarding the new channel number A, is set as a number 'INC'. The number INC represents a number of times by which reading operations are performed to read out waveform samples from the waveform memory 6.

In step S730, decision is made as to whether or not the number INC is equal to zero. If the step S730 judges that the number INC is not equal to zero, the DSP proceeds to step S740. The step S740 is activated with respect to the channel number A. Herein, '1' is added to a read address 'AD' for the waveform memory 6 so as to produce a next read address 'AD'; and '1' is added to the write-pointer value WP for the ring buffer RB so as to produce a next write-pointer value 'NWP'. Then, the DSP proceeds to step S750 in which the read address AD is outputted for the waveform memory 6. In step S760, '1' is subtracted from the number INC to produce a new number for the number INC. Thus, execution of the interrupt setting process is completed.

If the step S730 judges that the number INC is equal to zero, it is indicated that a number of times, by which reading operations are performed to read out waveform samples in connection with the channel number A, is zero. In that case, the DSP proceeds back to the step S700 again. Thus, a series of steps, which start from the step S700, are repeated until the channel number A coincides with the last channel number N.

As described above, the interrupt setting process is provided to send a read address to the waveform memory 6 so that a next waveform sample will be read out using the read address.

Figure 10:
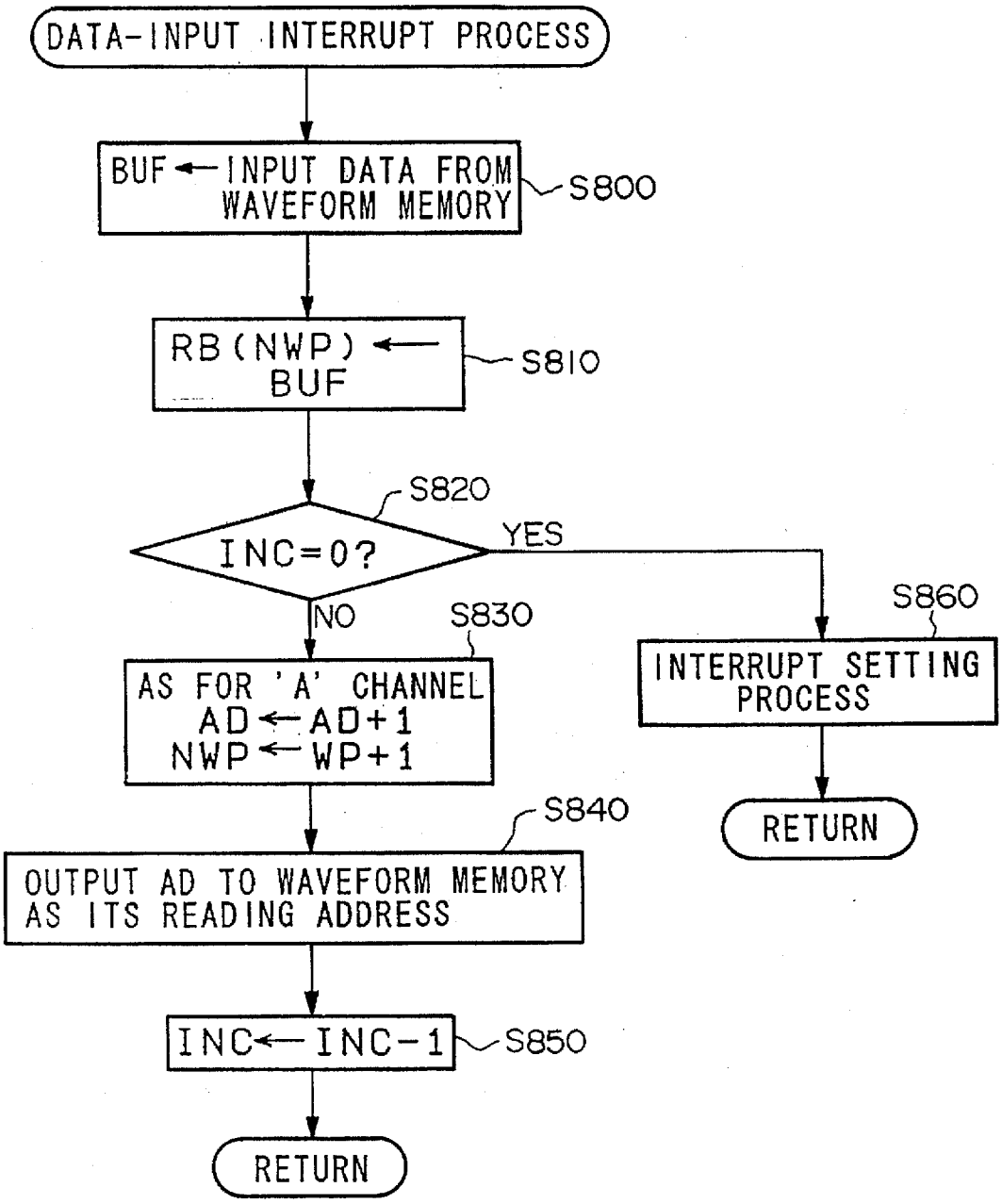
FIG. 10 is a flowchart showing a data-input interrupt process.

When a predetermined period of time has passed away after the waveform memory 6 receives the read address sent thereto, reading of the waveform sample designated by the read address is completed. At that moment, a data-input interrupt process is activated. FIG. 10 is a flowchart showing the data-input interrupt process. In first step S800, data representative of the waveform sample read from the waveform memory 6 is retained by a buffer 'BUF'. In next step S810, the data of the buffer BUF is written into the ring buffer RB at an address designated by the write-pointer value NWP. In step S820, decision is made as to whether or not the number INC is equal to zero.

If the step S820 judges that the number INC is not equal to zero, it is necessary to further read out a waveform sample (or waveform samples) from the waveform memory. In order to do so, the DSP proceeds to step S830. The step S830 is activated with respect to the channel number A. Herein, '1' is added to the read address AD to produce the next read address AD; and '1' is added to the write-pointer value WP to produce the next write-pointer value NWP. Next, the DSP proceeds to step S840 in which the read address AD is outputted for the waveform memory 6. In step S850, '1' is subtracted from the number INC to produce a new number for the number INC. Thus, execution of the data-input interrupt process is completed.

As described above, after inputting of a waveform sample read out is completed, the read address AD is progressed by '1', so that the DSP makes a preparation for reading out a next waveform sample from the waveform memory 6. After the predetermined period of time has passed away, reading of the next waveform sample designated by the read address progressed is completed; therefore, the data-input interrupt process is activated again. In the middle of execution of the data-input interrupt process, when the step S820 judges that the number INC becomes equal to zero, the DSP proceeds to step S860 in which the aforementioned interrupt setting process is performed again. In short, the interrupt setting process and data-input interrupt process, which are required for a next tone-generation channel, are performed on demand.

By repeating the above-mentioned processes, waveform samples, which are required for the tone-generation channels respectively, are written into the ring buffer RB.

Incidentally, the ring buffer is provided independently for each tone-generation channel.

As described before, two low-pass-filter processes are employed to avoid occurrence of the folding noises. Herein, the low-pass-filter process A copes with a situation in which an increase of pitch is limited in one-octave range. Therefore, the low-pass-filter process A can be realized in practice by a second-order IIR filter or the like. On the other hand, the low-pass-filter process B copes with a situation in which an increase of pitch exceeds one octave. Hence, a sharp filter characteristic is required. Thus, a fourth-order IIR filter or the like is employed to realize the low-pass-filter process B in practice. In each of the low-pass-filter processes, a cut-off frequency 'fc' is set as follows:

$$fc=(fs/2)\div FN$$

where 'fs' represents a sampling frequency at recording to the waveform memory; and the cut-off frequency fc is determined based on the sampling frequency fs.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. A musical tone creating apparatus comprising:

a plurality of musical tone generation channels;

a waveform memory for storing waveform samples;

a program memory containing read programs for reading waveform samples from the waveform memory and corresponding creation programs for utilizing the read waveform samples to create musical tone signals; and computation means for reading waveform samples for each designated tone generation channel from the waveform memory in accordance with a designated read program and creating a musical tone signal in association with the designated tone generation channel utilizing the read waveform samples in accordance with a corresponding creation program, wherein the computation means executes a designated read program in accordance with first timings and a corresponding creation program in accordance with second timings that are independent of the first timings with regard to the designated tone generation channels, and executes the designated read program prior to executing the corresponding creation program.

2. A musical tone creating apparatus according to claim 1, wherein said computation means comprises:

read timing allocation means for allocating a waveform-sample read out timing for each said designated tone generation channel;

tone generation timing allocation means for allocating a tone data creation timing for each designated tone generation channel, said tone generation allocation means operating independently of said tone generation timing means;

means for reading out, in a time division manner, waveform samples from the waveform memory for each particular designated tone generation channel, each waveform being read out in accordance with the waveform sample read out timing allocated for the particular tone generation channel; and means for creating, in a time division manner, musical tone data with respect to each particular designated tone generation channel based on the waveform samples read out for the particular tone generation channel and in accordance with the tone data creation timing allocated for the particular tone generation channel.

3. A musical tone creating apparatus comprising:

a waveform memory for storing waveform samples;

pitch designating means for designating a pitch for a musical tone to be generated;

address generating means for generating an address by accumulating an F-number corresponding to the pitch designated by the pitch designating means;

reading means for reading waveform samples from the waveform memory in accordance with an integer part of the address;

temporary storing means for temporarily storing the waveform samples read from the waveform memory;

low pass filter means for removing high frequency components of the waveform samples read by the reading means prior to storing the waveform samples in the temporary storing means only if the F-number exceeds a predetermined threshold; and interpolation means for using the integer part of the address as a reading address by which the waveform samples stored in the temporary storing means are read from the temporary storing means and for using a decimal part of the address to perform an interpolation operation on the waveform samples read from the temporary storing means.

4. The apparatus of claim 3, wherein the predetermined threshold corresponds to an F-number at which frequency components in the waveform samples read by the reading means cause a folding noise.

5. A musical tone creating apparatus comprising:

computation means for generating a plurality of musical tone signals in a time division manner during a sampling period comprising a predetermined number of clock cycles;

determining means, responsive to a musical tone generation instruction designating a musical tone signal to be generated, for determining a number of clock cycles necessary to generate the designated musical tone signal;

securing means for securing the necessary number of clock cycles determined by the determining means from among unsecured clock cycles composing the sampling period; and computation control means for controlling the computation means to generate the designated musical tone signal using the number of clock cycles secured by the securing means.

6. A musical tone creating apparatus comprising:

a waveform memory for storing waveform samples;

pitch designating means for designating pitches for musical tones to be generated;

computation means for generating in a time division manner during a sampling period comprising a predetermined number of clock cycles the musical tones having pitches designated by the pitch designating means, said computation means generating an address for each designated pitch by accumulating an F-number associated with the designated pitch, reading waveform samples from the waveform memory for each designated pitch in accordance with an integer part of the address generated for the designated pitch, performing an interpolation process on the read waveform samples in accordance with a decimal part of the address generated for the designated pitch for which the waveform samples were read;

determining means for determining for each designated pitch a number of clock cycles necessary to generate the designated pitch;

securing means for securing for each designated pitch the necessary number of clock cycles determined by the determining means from among unsecured clock cycles composing the sampling period; and computation control means for controlling the computation means to generate each musical tone having the designated pitch using the clock cycles secured by the securing means.

7. A musical tone creating apparatus according to claim 6 wherein the number of clock cycles necessary to generate a particular designated pitch includes clock cycles for performing a low pass filtering operation on the waveform samples associated with the particular designated pitch if the F-number of the particular designated pitch exceeds a predetermined threshold.

8. A musical tone creating apparatus comprising:

a waveform memory for storing waveform samples;

read cycle determining means for determining minimum numbers of read cycles necessary to read waveform samples associated with musical tones to be generated;

reading means for reading, during first time periods, the waveform samples associated with the musical tones to be generated from the waveform memory using the minimum numbers of read cycles determined by the determining means; and creation means for creating, during second time periods, musical tone data utilizing the waveform samples read by the reading means, wherein the reading means operates in accordance with first timings and the creation means operates in accordance with second timings, and the first timings are independent of the second timings.

9. A musical tone creating apparatus comprising:

a waveform memory for storing waveform samples;

number designating means for designating a number of reading operations necessary to read waveform samples from the waveform memory for each of a plurality of tone generation channels;

reading means for reading waveform samples from the waveform memory for each of the plurality of tone generation channels utilizing all the numbers of reading operations determined by the determining means; and tone generating means for generating musical tone data using the waveform samples read from the waveform memory, wherein the tone generating means operates in accordance with first timings and the reading means operates in accordance with second timings, and the first timings are independent of the second timings.

10. A musical tone creating apparatus comprising:

a waveform memory for storing waveform samples;

pitch designating means for designating a pitch for a musical tone to be generated;

first address designating means for sequentially designating addresses for the waveform memory so as to read out waveform samples;

first buffer means for temporarily storing the waveform samples read from the waveform memory;

low-pass filter means for removing high frequency components of the waveform samples stored in the first buffer means to avoid occurrence of a folding noise;

second buffer means for temporarily storing waveform samples supplied thereto from the first buffer means through the low-pass filter means;

second address designating means, responsive to the pitch of the musical tone signal designated by the pitch designated means, for designating addresses by which the waveform samples temporarily stored in the second buffer means are read out;

interpolation means for performing an interpolation operation on the waveform samples read from the second buffer means;

musical tone creating means for creating musical tone data using musical tone parameters and the interpolated waveform samples created by the interpolation means; and accumulation means for accumulating musical tone data generated with respect to a plurality of channels which operate in a time-division manner, whereby the musical tone creating apparatus creates musical tone signals based on the accumulated musical tone data.

11. A musical tone creating apparatus according to claim 10 wherein the folding noise occurs when skipping of reading operations on the waveform memory occurs; and when the low-pass filter means is not activated, the waveform samples, outputted from the first buffer means, are directly transferred to the second buffer means.

12. A musical tone creating apparatus according to claim 10 wherein the first buffer means comprises a first ring buffer and the second buffer means comprises a ring second buffer.

13. A musical tone creating apparatus according to claim 10 further comprising means, responsive to a frequency number of the designated pitch, for determining a cut off frequency for the low pass filter means.

14. A musical tone creating apparatus according to claim 10 wherein the musical tone parameters correspond to a tone color characteristic and an envelope characteristic.

15. A musical tone generating apparatus comprising:

tone designating means for designating a plurality of tones;

a plurality of tone generation channels;

means, responsive to designation of a tone, for assigning the designated tone to a tone generation channel and allocating a number of tone generation program steps for generation of the designated tone;

executing means for generating a tone in each tone generation channel to which a musical tone has been assigned by executing the tone generation program steps which have been allocated for the generation of the designated tones in a time division manner during a sampling period, the executing means being capable of executing a maximum total number of tone generation program steps during the sampling period; and means, responsive to designation of a new tone, for determining whether a number of the maximum total number of tone generation program steps that are not currently allocated to generating currently designated tones is sufficient to generate the newly designated tone.

16. The musical tone generating apparatus of claim 15 further comprising:

means for terminating assignment of a designated tone currently assigned to one of the tone generation channels and freeing program steps allocated for generation of the designated tone currently assigned to the one of the tone generation channels if the determining means determines that the number of the maximum total number of program steps that are not currently allocated to generating a designated tone is not sufficient to generate the newly designated tone.

17. A musical tone creating apparatus comprising:

a waveform memory for storing waveforms;

tone designating means for designating tones to be generated;

read number determining means for determining, for each one of a plurality of tones designated by said tone designating means, a minimum number of read operations necessary to read waveform samples from said waveform memory, said number being based on a pitch of said one of said plurality of tones designated by said tone designating means;

reading means for reading waveform samples from said waveform memory in accordance with said numbers of read operations determined by said determining means; and tone generating means for generating said plurality of tones designated by said tone designating means by processing said waveform samples read by said reading means, wherein said read number determining means determines said minimum number of operations necessary to read particular waveform samples independently of a number of operations utilized by said tone generating means to process said particular waveform samples.

18. A musical tone creating apparatus comprising:

a waveform memory for storing waveform samples;

read number determining means for determining a minimum number of read cycles necessary to read waveform samples from said waveform memory corresponding to a plurality of tones to be generated;

reading means for reading, in accordance with a plurality of time division channels operating during first time periods, said waveform samples corresponding to said plurality of tones to be generated utilizing said minimum number of read cycles determined by said read number determining means; and tone generating means for generating said plurality of musical tones by processing said waveform samples read by said reading means in accordance with said plurality of time division channels operating during second time periods, wherein said reading means operates during said first time periods in accordance with first period channel timings and said tone generating means operates during said second time periods in accordance with second period channel timings, and said first period channel timings are independent of said second period channel timings.

* * * * *